United States Patent [19]

Iversen

[11] Patent Number: 5,077,781

[45] Date of Patent: Dec. 31, 1991

[54] ROTATING SHAFT ASSEMBLY FOR X-RAY TUBES

[76] Inventor: Arthur H. Iversen, 15315 Sobey Rd., Saratoga, Calif. 95070

[21] Appl. No.: 472,256

[22] Filed: Jan. 30, 1990

[51] Int. Cl.[5] ..... H01J 35/10

[52] U.S. Cl. ..... 378/200; 378/144; 378/132; 378/199

[58] Field of Search ..... 378/144, 200, 127, 128, 378/130, 132, 141, 199, 202, 131, 125; 384/478

[56] References Cited

U.S. PATENT DOCUMENTS 4,130,772 12/1978 Kiissel et al. ..... 378/144
4,622,687 11/1986 Whitaker et al. ..... 378/144
4,625,324 11/1986 Blaskis et al. ..... 378/144
4,928,296 5/1990 Kadambi ..... 378/200

*Primary Examiner*—Edward P. Westin
*Assistant Examiner*—Don Wong
*Attorney, Agent, or Firm*—Streich Lang

[57] ABSTRACT

There is disclosed a unitized rotating shaft assembly comprising an outer alignment sleeve within which are mounted a rotating ferrofluid seal, a first bearing, a stator a second bearing and a rotating union; there being a first follow shaft affixed to the inner races of the first and second bearing, the hollow shaft having stators mounted opposing the rotor and there being a second hollow shaft concentric with the first hollow shaft to provide separate conduits for the input and discharge of coolant.

17 Claims, 2 Drawing Sheets

ROTATING SHAFT ASSEMBLY FOR X-RAY TUBES

TECHNICAL FIELD

The present invention relates to rotating shaft assemblies and particularly concerns hermetically sealed rotating shaft assemblies suitable for penetration into a vacuum or a controlled atmosphere environment for use in x-ray tubes and other applications.

BACKGROUND OF THE INVENTION

Penetration of a rotating shaft assembly into a controlled environment such as a vacuum or controlled atmosphere, e.g. hydrogen, presents difficulties especially if contaminants must be excluded from the controlled environment.

One of the most effective sealing techniques employed for rotating shafts incorporates the use of ferrofluids. Ferrofluids enable high rotational speeds to be obtained, introduce negligible contaminants in a vacuum, are effective at high vacuums, e.g. $10^{-8}$ mm hg and have long life. Ferrofluid seals are used extensively as the sealing medium for the rotating vacuum seals for liquid cooled rotating anode x-ray tubes.

The construction of sealed rotating shaft assemblies for use with liquid cooled rotating anode x-ray tubes is generally cumbersome and is custom designed for each application. The result is an expensive assembly that is generally bulky and not readily repairable or replaceable.

The need exists for a compact, low cost hermetically sealed high speed rotating shaft penetration that is readily replaceable and can provide for internal cooling of structures mounted on the shaft.

SUMMARY OF THE INVENTION

The present invention provides for a compact, low cost hermetically sealed unitized rotating shaft assembly.

The present invention provides a compact, low cost hermetically sealed unitized rotating shaft assembly that is readily repairable.

The present invention provides a compact, low cost hermetically sealed unitized rotating shaft assembly that is readily replaceable.

The present invention provides for a unitized hollow rotating shaft assembly wherein at least one hollow rotating shaft is provided for coolant flow to a heated structure mounted on the hollow shaft.

DESCRIPTION OF PREFERRED EMBODIMENTS

Figure 1:
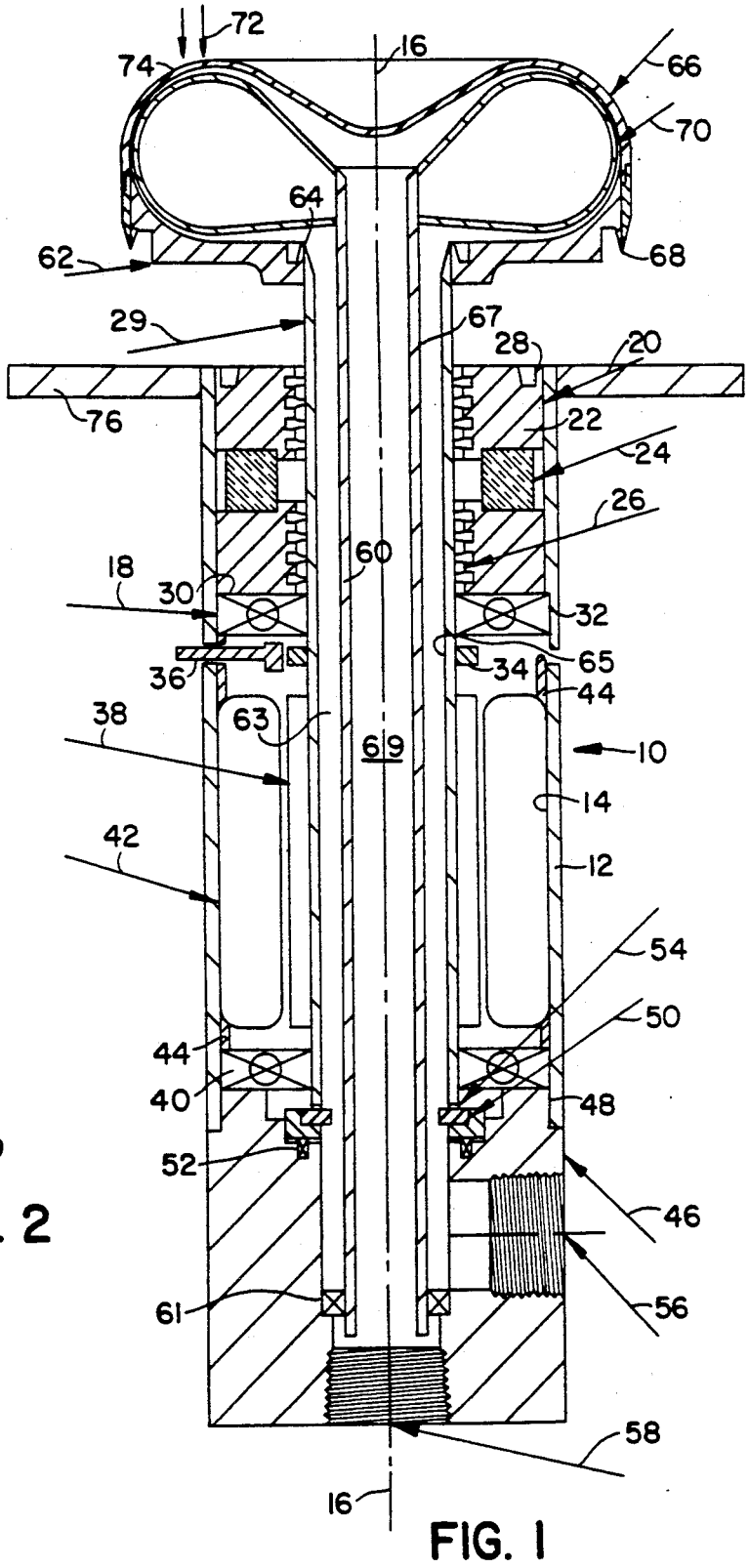
FIG. 1 is a cross section view of a unitized rotating shaft assembly illustrating the several components positioned and aligned by the alignment sleeve, and a liquid cooled anode mounted on the hollow rotating shaft.
Figure 2:
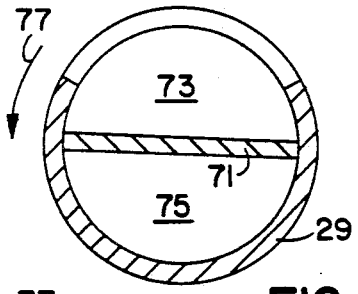
FIG. 2 is a cross section end view of the hollow rotating shaft with a septum in the center to provide a coolant input and discharge conduit.

Referring now to FIG. 1, shown is a unitized hollow rotating shaft assembly as might be used with a liquid cooled rotating anode x-ray tube or as a chill wheel in metallurgy for rapid solidification of metals, ceramics etc. Unitized assembly 10 has as its central construction feature, alignment sleeve 12 whose inside diameter 14 is maintained precise with central axis 16.

For convenience, inside diameter 16 is shown as a fixed diameter for the length of sleeve 12. Inside diameter 14 may also be stepped 32 to permit easy component insertion and to provide fixed positioning within the sleeve for the various elements, e.g. bearings 18, to be installed. The axis 16 of the various stepped diameters would be coincident as with the fixed diameter thereby assuring precise alignment of all components within sleeve 12.

Construction of the unitized assembly proceeds as follows: Ferrofluid vacuum seal 20 comprising magnetic pole pieces 22, magnet 24 and ferrofluid 26 is slipped into sleeve 12 and hermetically sealed at mating lips 28 of sleeve 12 and ferrofluid seal 20. Sealing may be by heliarc weld, braze, epoxy, "O" ring etc. The outside diameter of ferrofluid seal 20 and the inside diameter of sleeve 12 are a precise slip fit, e.g. 0.001 inch gap or may be a press fit, such that the axis 16 of sleeve 12 and ferrofluid seal 20 are substantially coincident. Next, a first bearing 18 to which outer rotating shaft 29 is firmly attached to the inner race of bearing 18 is inserted into sleeve 12 and pressed against ferrofluid seal 20 at 30. Alternatively, a shoulder at 32 of slightly larger diameter may be incorporated in sleeve 12 to act as placement means.

A further alternative is to prepare a sub-assembly comprising hollow shaft 29 on which is mounted the first bearing 18, rotor 38 and a second bearing 40. Prior to inserting the second rear bearing 40, stator 42 is concentrically and axially positioned with rotor by sleeve 44 which is attached first to the outer race of first bearing 18 and likewise to second bearing 40 when it is next mounted on shaft 28. The electrically driven rotor and stator serve to rotate the anode, and like a motor can operate at high speeds.

Close proximity of the rotor 38 to the stator 42 provides tight coupling with consequent high torque and efficiency. The inner races of bearings 18 and 40 are positively attached to hollow shaft 29 thereby firmly positioning it. Mating diameter 48 of rotating union 46 is inserted into sleeve 12 and may be pressed against bearing 40. Union 46 is then attached to sleeve 12 to form a mechanically rigid structure, the entire assembly being anchored at the top end by the ferrofluid seal 20 welded at 28 to sleeve 12 and at the lower end, the rotating union 46 is fastened to sleeve 12.

Rotating union 46 comprises spring 52 loaded stationary seal face plate 50, e.g. carbon, pressing against rotating face seal 54 which is mounted on rotating hollow shaft 29 thereby forming a rotating liquid tight seal. Coolant input 56 and output 58 couplings provide for the flow of coolant. Inner hollow shaft 60, which is concentric within hollow shaft 29, and may be stationary or rotating provides for the isolation of input and discharge coolant flow. The outside diameter of shaft 60 is less than the inside diameter of shaft 29 thereby forming conduit 63.

Hollow shaft 60 is mounted at the rotating union 46 end by bearing structure 61 and at the opposing end by septum 70. Coolant flows in input 56 up conduit 63 defined by the inside surface 65 of shaft 29 and the outside surface 67 of shaft 60. Coolant discharge is through conduit 69 comprising the inside of hollow shaft 60 out through output 58 to a heat exchanger (not shown).

Figure 3:
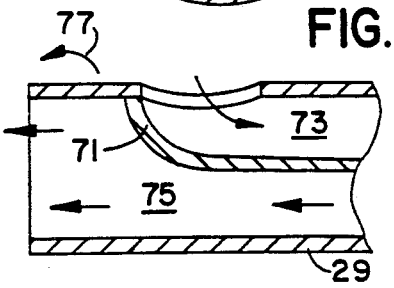
FIG. 3 is a cross section axial view of the hollow rotating shaft with a septum in the center to provide a coolant input and discharge conduit.
Figure 4:
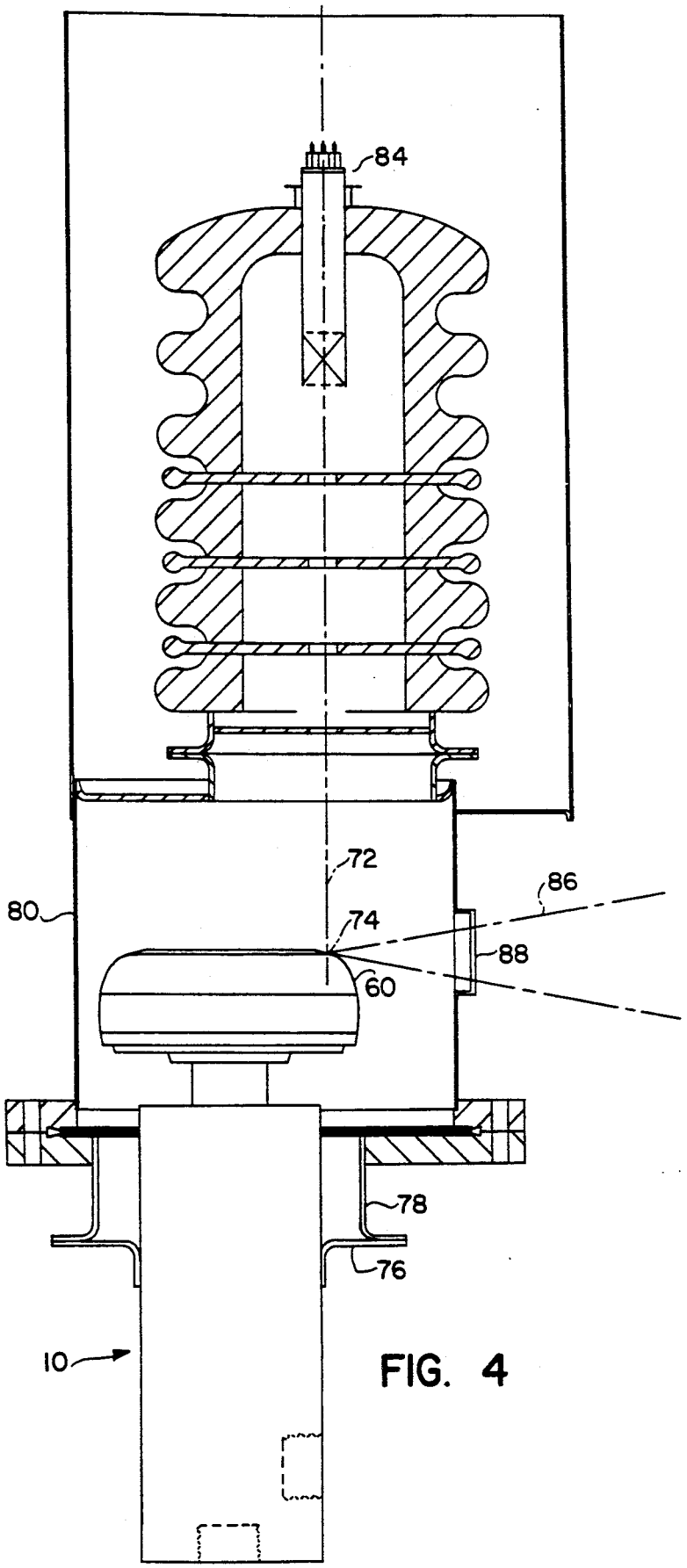
FIG. 4 is a cross section view of a liquid cooled rotating anode x-ray tube incorporating a unitized rotating shaft assembly.

Alternatively, inner hollow shaft 60 may be replaced by a septum 71 (FIG. 3) dividing the inside of outer rotating 77 shaft 29 into approximately two equal coolant conduits, input 73 and discharge 75. FIG. 4 illustrates construction and coolant flow of divided shaft 29 at the rotating union 46 end. Similar coolant input and discharge construction may be employed at the opposing end of shaft 29. Septum 71 need not provide a hermetic seal between coolant input 73 and discharge 75 conduits, but need only keep leakage within acceptable limits.

Depending upon the application, e.g. a liquid cooled rotating anode x-ray tube, hollow outer shaft 29 would have anode base 62 hermetically sealed at 64, e.g. heliarc welded or brazed. In turn, anode 66 is sealed, preferably by heliarc weld or brazing at 68 to base 62. Septum 70 is fastened e.g. by welding or brazing to inner shaft tube 60 which forms a complete coolant path from input 56 to output 58 couplers with coolant flowing between anode 66 and septum 70 thereby removing heat generated by the impingement of electron beam 72 on anode focal track 74. Flange 76, which may employ an "O" ring, conflat, etc. for a removable seal, and which is hermetically sealed to sleeve 12, provides for mounting the rotating shaft assembly to the vacuum envelope containing the electron gun, x-ray window, vacuum pump, etc.

When using the rotating shaft assembly in an energy beam device, e.g. a device employing charged particles such as electrons (x-ray tubes), or positive or negative ions, it is generally desirable to incorporate a commutator to convey the resulting electric current from the rotating shaft 29 to external circuitry (not shown) thereby minimizing any damage to bearings 18, 40 from arcing. A rotating commutator element 34 is attached to shaft 29 which is contacted by brush assembly 36 thereby forming a very low resistance electrical connection by substantially bypassing electrical current flow through bearings 18, 40 from rotating shaft to sleeve 12.

Though the above construction is described in terms of a liquid cooled rotating anode x-ray tubes, the same structure with only a few minor modifications could be employed in metallurgy in rapid solidification manufacturing facilities. Instead of an anode, it would be a chill wheel which employs a geometry similar to an anode. Instead of dissipating heat from an impinging electron beam, the heat generated by solidifying molten metal or other molten material, e.g. ceramic, would be dissipated, and operation could be in vacuum or a controlled atmosphere, e.g. nitrogen, forming gas etc. The design shown is suitable for any application or manufacturing process requiring contaminant free penetration into an environment, e.g. vacuum, that requires rotation and the removal of heat.

Construction of liquid cooled rotating anode x-ray tubes incorporating the unitized rotating shaft assembly is shown in FIG. 4. Flange 76 sealed to rotating shaft assembly 10 is sealed, e.g. heliarc welded to flange 78 sealed to tube housing 80. Liquid cooled rotating anode 60 is illuminated by electron beam 72 emanating from electron gun 84. X-rays 86 emanating from anode focal track 74 exit through x-ray window 88.

I claim:

1. A liquid cooled rotating assembly, comprising:

a continuous outer sleeve extending substantially the length of said assembly;

a ferrofluid rotating seal, said seal being hermetically sealed within said sleeve at an end of said sleeve, the outside diameter of said seal and the inside diameter of said sleeve being in close proximity to each other, and the respective axes of said sleeve and said seal being substantially coincident;

a first rotating bearing inserted into said sleeve and positioned in close proximity to said seal, the inside diameter of said sleeve and the outside diameter of said first bearing being in close proximity to each other, and the respective axes of said first bearing and said sleeve being substantially coincident;

an electric rotor inserted into said sleeve and positioned in close proximity to said first bearing, the inside diameter of said sleeve and the outside diameter of said rotor being in close proximity to each other, and the respective axes of said sleeve and said rotor being approximately coincident;

a second rotating bearing inserted into said sleeve, and positioned in close proximity to said rotor, the inside diameter of said sleeve and the outside diameter of said second bearing being in close proximity to each other, and the respective axes of said sleeve and said second bearing being substantially coincident;

a rotating union inserted into said sleeve and positioned in close proximity to said second bearing, the inside diameter of said sleeve and said rotating union being in close proximity to each other, and the respective axes of said sleeve and rotating union being substantially coincident;

a first hollow rotating shaft passing through said first and second bearings, said rotor, and said seal and having a first end terminating in said rotating union, said first end having mounted thereon a rotating seal face which engages a stationary seal face of said union in a liquid sealing relationship, said first hollow shaft having its outside diameter attached to the inside diameter of the inner races of said first and second bearing, there being stator components affixed to the outside diameter of said first shaft between said first and second bearing and opposing said rotor, the respective axes of said sleeve and said first shaft being substantially coincident; and means for inputting and discharging coolant through the inside of said first hollow rotating shaft.

2. The assembly of claim 1, further comprising:

a hollow rotatable anode suitable for x-ray production attached to a second end of said first rotatable hollow shaft, there being a septum internal to and spaced from said anode thereby forming a coolant conduit between said anode and said septum; and means for causing coolant to flow through said coolant conduit over the internal surface of said anode thereby removing heat from said rotatable anode.

3. The assembly of claim 1, further comprising:

a hollow rotatable wheel, suitable for metallurgical rapid solidification, sealed to a second end of said first rotatable hollow shaft;

a septum internal to and spaced from said wheel thereby forming a coolant conduit therebetween; and means for causing coolant to flow through said coolant conduit over the internal surface of said wheel thereby removing heat from said wheel.

4. The assembly of claim 2, further comprising an electrical commutator mounted on the outside diameter of said first shaft and a contacting brush assembly mounted on said sleeve to conduct electric current from said rotating anode to a power supply.

5. The apparatus of claim 1, further comprising:

a hollow rotatable workpiece suitable for receiving energy in the form of heat, sealed to the second end of said first rotatable hollow shaft, there being a septum internal to and spaced from said hollow rotatable workpiece thereby forming a coolant conduit; and means for causing coolant to flow through said coolant conduit over the internal surface of said workpiece thereby removing heat from said workpiece.

6. The assembly of claim 1, wherein a second hollow shaft is positioned within and concentric with said first hollow shaft, the outside diameter of said second shaft being smaller than the inside diameter of said first hollow shaft forming thereby a first conduit between said shafts, and the inside of said second hollow shaft comprising a second conduit thereby forming two conduits, one for input and one for the discharge of coolant.

7. The assembly of claim 1, wherein the inside of said hollow shaft is divided into approximately two equal segments by a septum extending approximately the length of said hollow shaft thereby providing separate conduits for the input and discharge of coolant through the inside of said hollow rotating shaft.

8. A liquid cooled, rotating anode assembly, comprising:

a stationary frame;

a first hollow, rotating cylindrical shaft configured for rotation with respect to said frame about a first rotational axis, said shaft having a first outer diameter, a first end configured for disposition within a first zone, and a second end configured for disposition within a second zone;

an anode secured to said first end of said first shaft for rotation therewith in said first zone;

a generally cylindrical ferrofluid seal sealingly disposed about said first outer diameter of said first shaft, including means for maintaining a pressure differential between said first and said second zones, said ferrofluid seal having a second outer diameter;

a first bearing having an inner race mounted to said first outer diameter of said first shaft for rotation therewith, and an outer race having a third outer diameter;

a second bearing spaced apart from said first bearing and having an inner race mounted to said first outer diameter of said first shaft for rotation therewith, and an outer race having a fourth outer diameter; and a one-piece alignment sleeve rigidly affixed to said frame, said alignment sleeve including a lengthwise bore having a substantially circular cross section and a longitudinal axis substantially coincident with said first rotational axis of said first shaft, wherein said lengthwise bore comprises an inner surface including:

a first lengthwise segment configured to support said ferrofluid seal and having an inner diameter approximately equal to said second outer diameter;

a second lengthwise segment configured to support said first bearing and having an inner diameter approximately equal to said third outer diameter; and a third lengthwise segment configured to support said second bearing and having an inner diameter approximately equal to said fourth outer diameter.

9. The assembly of claim 8, wherein said third and fourth outer diameters are approximately equal.

10. The assembly of claim 8, wherein said second, third and fourth outer diameters are approximately equal.

11. The assembly of claim 8, wherein said third and fourth outer diameters are approximately equal to each other and greater than said second outer diameter.

12. The assembly of claim 8, wherein said inner surface of said lengthwise bore comprises an essentially constant diameter along a substantial portion of the length thereof, including said first, second, and third lengthwise segments.

13. The assembly of claim 8, wherein said alignment sleeve further comprises an outer cylindrical surface having an essentially circular cross section.

14. The assembly of claim 8 further comprising means for rotating said shaft, including:

a rotator symmetrically disposed about said first outer diameter; and a stator symmetrically disposed along said inner surface of said alignment sleeve proximate said commutator.

15. The assembly of claim 14, wherein said means for rotating is disposed intermediate said first and second bearings.

16. The assembly of claim 8 wherein said alignment sleeve comprises a first end and a second end, and said ferrofluid seal is disposed at said first end of said alignment sleeve, the assembly further comprising:

a second hollow shaft having a septum secured to an end thereof, said septum being disposed within said anode, said second shaft having a lengthwise axis coincident with said rotational axis, said second shaft being substantially disposed within said first shaft and having a second end extending beyond said second end of said first shaft;

a union rigidly secured to said second end of said alignment sleeve and having first means for maintaining a rotating fluid seal between said union and said second end of said first shaft, and second means for maintaining a rotating fluid seal between said union and said second end of said second shaft.

17. A liquid cooled rotating anode assembly, comprising:

a hollow rotating shaft having a first outer diameter, a first end disposed in a first zone, and a second end disposed in a second zone;

an anode secured to said first end of said shaft for rotation therewith in said first zone;

a ferrofluid seal disposed about said first outer diameter of said shaft and configured to maintain a pressure seal between said first and second zones;

a first bearing disposed about said first outer diameter of said shaft proximate said ferrofluid seal and configured to support said shaft;

a second bearing disposed about said first outer diameter of said shaft and spaced apart from said first bearing;

an integral alignment sleeve of unitary construction comprising an inner surface having a circular cross section, said inner surface being configured to contact and thereby support said first bearing, said second bearing, and said ferrofluid seal in substantially concentric relation to one another and to said shaft.

* * * * *